US006640802B2

(12) United States Patent
Grando et al.

(10) Patent No.: US 6,640,802 B2
(45) Date of Patent: Nov. 4, 2003

(54) DEVICE FOR MANUAL ACTUATION OF A GAS DISTRIBUTION VALVE CONNECTED TO A BURNER

(75) Inventors: Maurizio Grando, Chirignago (IT); Michele Bortoliero, Monselice (IT)

(73) Assignee: OP Controls SpA, Pernumia (IT)

( * ) Notice: Subject to any disclaimer, the term of this patent is extended or adjusted under 35 U.S.C. 154(b) by 32 days.

(21) Appl. No.: 10/014,491

(22) Filed: Dec. 14, 2001

(65) Prior Publication Data

US 2003/0111073 A1 Jun. 19, 2003

(51) Int. Cl.[7] ..... F24B 1/187; F23D 5/16
(52) U.S. Cl. ..... 126/503; 126/512; 137/66
(58) Field of Search ..... 126/502, 503, 126/512; 137/66, 625.12; 251/294

(56) References Cited

U.S. PATENT DOCUMENTS 1,898,863 A * 2/1933 Williams ..... 431/255
4,569,503 A * 2/1986 Karr, Jr. ..... 251/14
4,763,690 A * 8/1988 Martin ..... 137/613
4,763,754 A * 8/1988 Coppolani et al. ..... 181/237
5,772,423 A * 6/1998 Mandir ..... 431/254
6,352,428 B1 * 3/2002 Uribetxebarria et al. ..... 431/80

* cited by examiner

*Primary Examiner*—Alfred Basichas
(74) *Attorney, Agent, or Firm*—Dykema Gossett PLLC

(57) ABSTRACT

The invention relates to an actuation device of a gas distribution valve connected to a burner provided with a control thermocouple of the flame presence, said valve (100) comprising: a gas inlet duct (1); two or more gas delivery ducts (2, 3, 4); gas interception means (8, 10) controlling selectively said inlet duct (1) and said delivery ducts (2, 3, 4), said means can be actuated through axial movement of a stem (5) belonging to said valve; electrical means (6, 7, 101) cooperating with said thermocouple and said interception means of the gas inlet duct. Said device comprises a flexible metal wire (14) sliding inside the sheath and fixed at one end (141) to said stem (5) of said valve (100) and at the other end (142) to a control lever (20) rotatable relative to a support plane (30) according to discreet positions (21, 22, 23, 24, 25) corresponding to the various positions of said interception means.

7 Claims, 3 Drawing Sheets

31
201
22
20
30

100
10
2
101
1
3
51
9
8
11
4
5
12
13
19
7
151
14
61
6
16
18
141
17
50
15
152
14
25
24
31
23
30
201
142
21
22
20

DEVICE FOR MANUAL ACTUATION OF A GAS DISTRIBUTION VALVE CONNECTED TO A BURNER

The present invention relates to a device for manual actuation of a gas distribution valve connected to a burner.

It is well known that gas burners, for instance connected to boilers of a heating system or hot water production, are controlled by gas distribution valves provided with safety devices so that gas delivery is effected only in presence of a flame. For this reason at starting when the flame begins to be produced, gas delivery is ensured by a manual actuation of the valve held in an unstable position and only the direct, manual and voluntary action of the operator allows discharge of gas. A thermocouple sensing the presence of the flame thus reaching a predetermined temperature, allows to pass from the position of valve opening instability to the stable position and subsequently to low, medium and high gas erogation phases. In boilers such as wall boilers for producing hot water or for heating systems, the manual actuation of the gas distribution valve connected to the burner, is easily effected as the boiler is installed in an easily reachable and comfortable position.

On the contrary actuation of similar devices not used for boilers but for instance for fireplaces as shown in FIG. 1, is not at all easy, where the burner 41 has the gas distribution valve 42 generally close to the burner 41 so that the manual actuation of the valve 42 according to the presently used technique would be really problematic as it is very inconvenient and dangerous.

Some manufacturers approached the problem of remote control of the distribution valve through a set of leverages acting on the stem controlling the various positions of gas distribution. Such leverages resulted to be rather unsuitable for effecting a safe piloting action of the gas distribution valve especially in the starting phase when the valve has an unstable position. This happens because the frictions inevitably produced at the joints of the leverages after several hours of operation, may block the valve at positions that should be unstable thus preventing a correct operation of the safety devices.

The object of the present invention is to overcome the limits of the prior art. Indeed the main object is to carry out a device for manual actuation of gas distribution valves that is reliable and is not sensitive to aging and deterioration conditions due to use.

Another object is to provide a remote actuation device which is simple, cheap and of easy use and easily applicable to presently available distribution valves as well.

Another object is also to provide a device which is cheap and easily applicable to the users in need thereof.

These and other objects that will be better apparent from the following description are attained by an actuation device for a gas distribution valve connected to a burner provided with a thermocouple controlling the presence of flame, said valve comprising: a gas inlet duct; two or more gas delivery ducts; gas interception means controlling selectively said inlet duct and said delivery ducts that can be actuated through the axial movement of a stem of said valve; electrical means cooperating with said thermocouple and said interception means of the gas inlet duct, where said device is characterized by comprising a flexible metal wire sliding inside a sheath fixed at one end to said stem and at the other end to a control lever rotatable relative to a support plain according to discreet positions corresponding to the various positions of the interception means.

Advantageously according to the invention the flexible metal wire protected by sheath, ensures transmission of motion from the lever to the control stem without significant friction. It is therefore clear that such a device is particularly adapted to be used near heat sources such as a gas burner.

Further characteristics and features of the invention will be better understood from the following description of a preferred embodiment given as an illustrative but non limiting example and shown in the accompanying sheets of drawings in which.

Figures 3, 4:
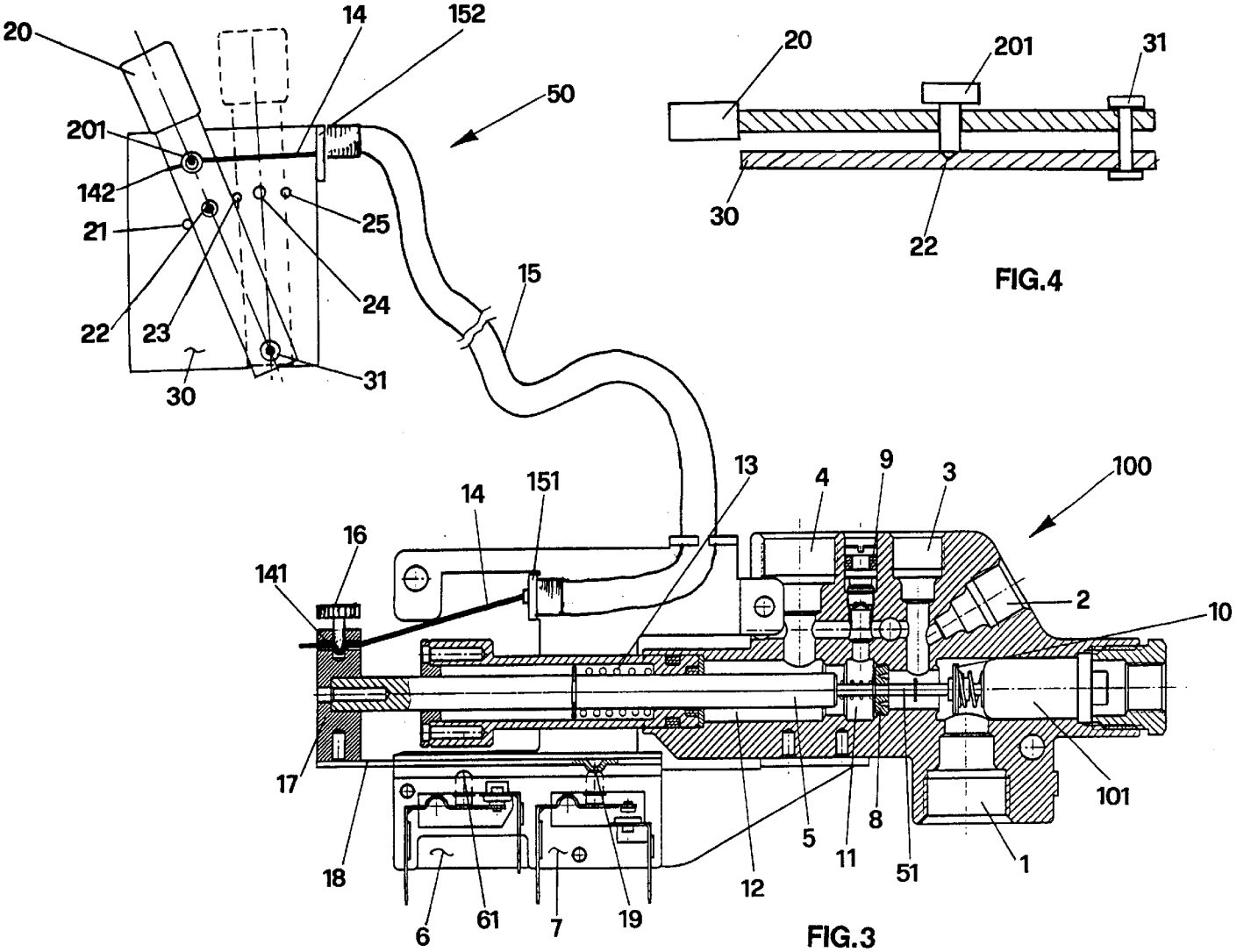
FIG. 3 is a cross sectional view of a gas distribution valve connected to the device of the invention.
FIG. 4 is a cross sectional view of the actuation lever belonging to the device of the invention.
Figure 5:
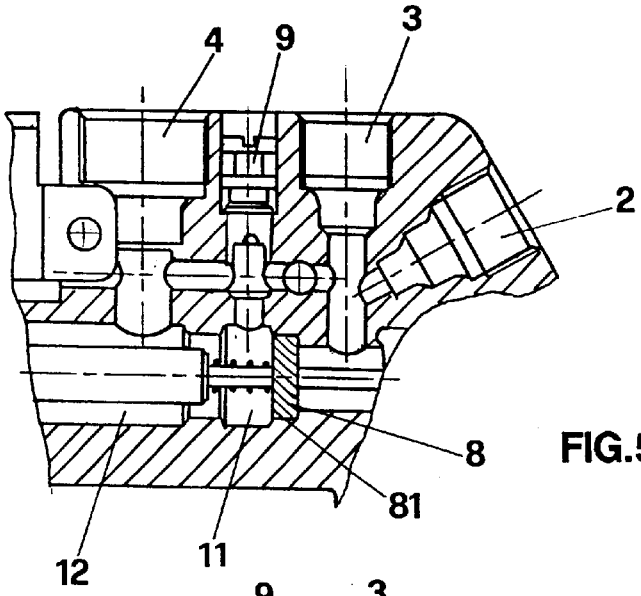
FIGS. 5, 6 and 7 show different arrangements of the gas plug inside the valve corresponding to different positions of the lever of the device of the invention.

With reference to the mentioned FIGS. of the drawings and more particularly to FIG. 3, one can see that the gas distribution valve generally indicated with numeral 100, has a gas inlet duct 1 with a gas interception means or plug 10 which is controlled by the rod 51 belonging to a stem 5. The interception means 10 is also connected to the solenoid valve 101 that holds the plug 10 open as explained below, when the enabling signal arrives from the thermocouple not shown in the drawing, detecting the presence of flame in the burner. Downstream the plug 10 there are two gas delivery ducts 2 and 3 receiving gas when the plug 10 is open. In the position shown in FIG. 3, a second plug 8 does not allow gas to flow into the chamber 11 thus reaching the regulator 9 and consequently the other gas delivery duct 4. The valve as shown in FIG. 3, that is with the plug 10 open and the second plug 8 in the illustrated position 81 corresponding to FIG. 5, corresponds to the unstable position of arming the solenoid valve 101 when starting the burner 41 is initiated, as well as to the stable position reached when the thermocouple not shown in the drawing enables the solenoid valve 101 to hold the plug 10 open even in absence of manual pressure pushing the rod 51 in the direction of keeping the plug 10 open.

According to the invention the rod 51 is held in the position shown in FIG. 3 by a flexible metal wire 14 having an end 141 fixed to a block 17 connected to the end of stem 5 and fastened by a screw 16, and at the other end 142 fixed to a control lever 20 that can rotate parallel to the support plane 30 on the pin 31 so as to take various positions as shown in FIG. 3.

More particularly the lever 20 when the burner is started and therefore when the pilot flame starts, takes the position corresponding to the notch 21 which is an unstable position. Indeed were the lever 20 released from the manual action, the plug 10 would close gas delivery and lever 20 would go to the position defined by notch 22. This would happen because the wire 14 is returned to such position by spring 13 acting on the stem 5 in the direction of extending it out from valve 100 and stops on the first notch 22 on the plate 30, that can be seen also in FIG. 4. At position 22, lever 20 remains stable in its position provided that the solenoid 101 is energized by closure of the thermocouple detecting the presence of flame.

Indeed in this case the rod of the solenoid valve 101 is retracted and holds the plug 10 open allowing gas flow.

Figure 6:
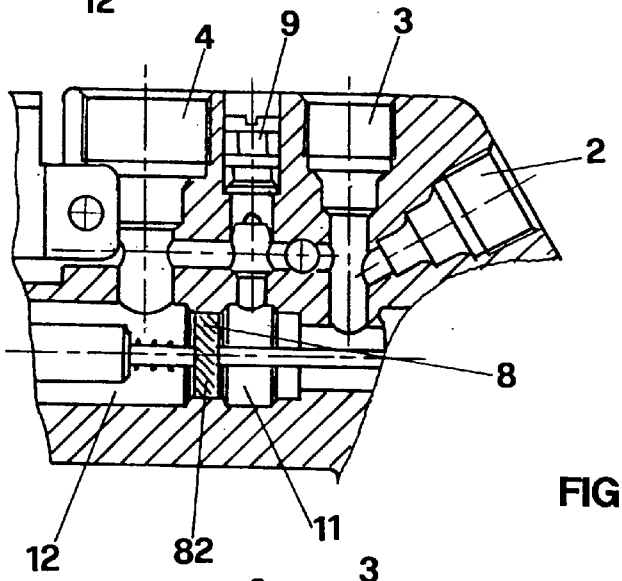

According to the device of the invention it is possible to actuate the control lever 20 also in the positions 23 and 24 to obtain passage from minimum flame to medium flame in the burner at position 23, and from medium flame to maximum flame at position 24 respectively. When lever 20 passes from position 22 to position 23, the plug 8 as shown in FIG. 6 passes to position 82 thus allowing gas to flow into chamber 11 and therefore to pass regulator 9 allowing gas flow through the delivery duct 4 according to a controlled and adjustable quantity of gas.

Figure 7:
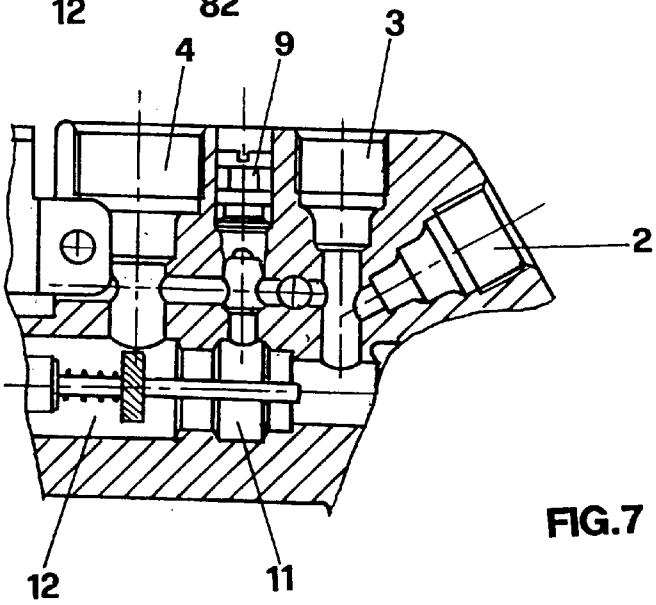

On the contrary when lever 20 passes from position 23 to position 24, the plug 8 as shown in FIG. 7, passes to chamber 12 and therefore gas may freely flow through duct 4 without necessarily passing through regulator 9. It is to be understood that in this condition maximum gas flow is obtained, because all the delivery ducts 2, 3 and 4 are open. When gas turning off condition is wanted, by further actuation of the lever to the right as shown in FIG. 3 until position 25 is reached, one obtains that projection 19 of rod 18 connected to stem 5 through the block 17, presses the push button 61 of switch 6 de-energizing the solenoid valve 101 so as to close the plug 10 and therefore the gas inlet duct.

To give certitude to the movements of the metal wire 14, it is of course necessary that the sheath 15 has the ends fixed in stable positions, as shown in FIG. 3, the sheath 15 is fixed with the end 151 to the support plate 102 of valve 100 and with the other end 152 to the support plate 30 of lever 20. As the flexible metal wire 14 is always under tension, being returned to the stem of the valve by spring 13 of stem 5, in order to hold the minimum, medium, maximum and stop positions of the control lever 20, it is necessary that this control lever is provided with a constraint means projecting from the lever as shown in FIG. 4, that in the illustrated example is the tip of a screw 201. Such a tip is received in the case of FIG. 4, in the notch 22 which is made on the support plate 30 of lever 20. In a similar way also the positions 23, 24 and 25 will be provided with corresponding notches, while position 21 corresponding to the unstable position is not provided with a notch. In this way the operator is obliged to hold the lever 20 in the starting position in a voluntary way until the thermocouple is actuated, thus allowing release of the lever 20 up to the position 22 where the flame takes the minimum position having been enabled by the solenoid valve 101.

Figure 1:
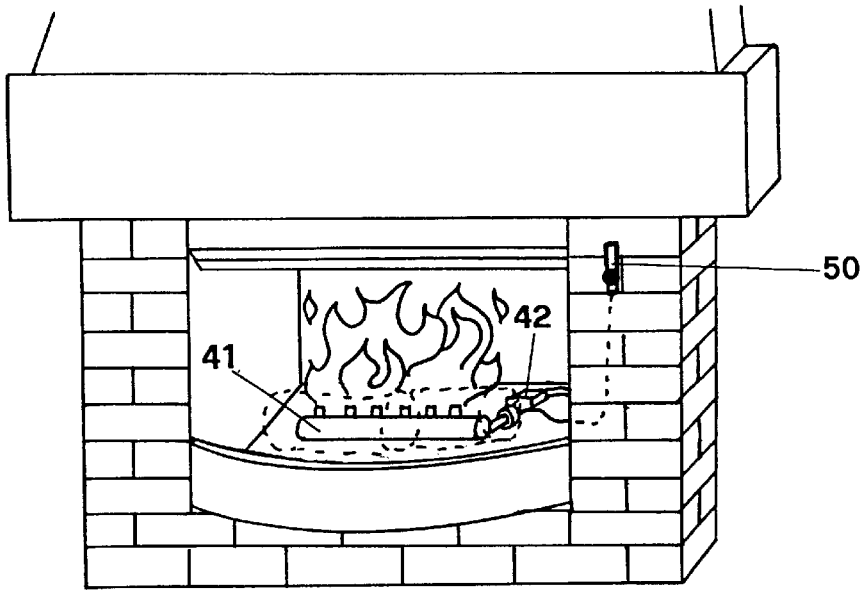
FIG. 1 shows a fireplace provided with the device of the invention.
Figure 2:
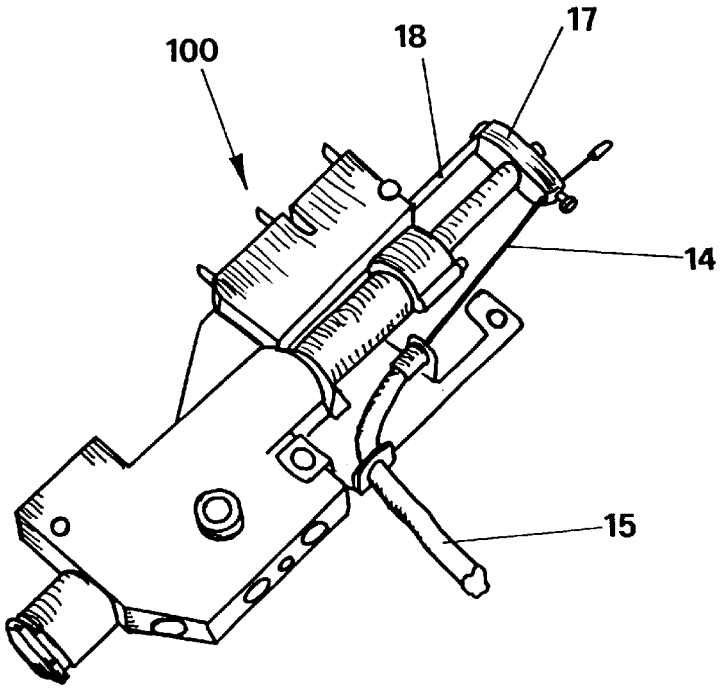
FIG. 2 shows a gas distribution valve with a partial view of the device of the invention.

The control unit 50 defined by lever 20 and support 30 of said lever, may therefore be arranged at the most convenient position for the operator as shown in FIG. 1, remote from the gas distribution valve connected to the burner in a very close position.

The objects of the invention are thus obtained that are to have provided a gas distribution valve with a remote actuation that does not shown any safety problems for its control and keeping its mechanical and safety features with time.

It is indeed clear that a flexible metal wire provided with a protection sheath for instance made of steel spiral, warrants the substantial absence of friction and therefore perfectly responds to the controls effected with lever 20 relative to actuation of stem 5 and therefore of the valve plugs in the desired direction.

What is claimed is:

1. An actuation device for a gas distribution valve connected to a burner provided with a control thermocouple for the flame presence, said valve comprising:

a gas inlet duct;

two or more gas delivery ducts;

at least one gas interception plug controlling selectively said inlet duct and said delivery ducts, said plug being controlled through axial movement of a stem belonging to said valve and being mounted on said stem for axial reciprocation therewith; and electrical system cooperating with said thermocouple and said interception plug for the gas inlet duct, wherein said device comprises a flexible wire sliding inside a sheath fixed at one end to said stem of said valve and at the other end to a control lever rotatable relative to a support plane according to discreet positions corresponding to various positions of the interception plug.

2. The device according to claim 1, wherein the sheath of said wire is fixed at one end to a support of said distribution valve and at the other end to a support of said control lever.

3. The device according to claim 1, wherein said lever is positionable according to predetermined positions, and being provided with at least one constraint projecting from said lever and being arranged on a corresponding notch existing on a support of said lever.

4. The device according to claim 3, wherein said at least one constraint is a screw tip.

5. The device according to claim 1, wherein said lever is constantly returned by the wire to a closure position of the gas inlet duct, said stem of said valve being connected to said wire pushed by a spring to said closure position.

6. The device according to claim 1, wherein said lever may be positioned according to a first unstable starting position of the burner in which the lever is being held by a voluntary action, a second stable position of minimum gas flow being reachable after the thermocouple of the burner actuated the electric system for keeping the gas inlet duct open.

7. The device according to claim 6, wherein said lever can be positioned to a third position corresponding to medium delivery of gas flow, to a fourth position corresponding to a maximum delivery of gas flow and to a fifth position in which the stem through a projection belonging to a rod connected thereto, intercepts a switch closing the gas delivery valve.

* * * * *